US009121271B2

(12) United States Patent
Shook

(10) Patent No.: US 9,121,271 B2
(45) Date of Patent: Sep. 1, 2015

(54) SYSTEM AND METHOD FOR CONFORMANCE CONTROL IN A SUBTERRANEAN RESERVOIR

(75) Inventor: George Michael Shook, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 950 days.

(21) Appl. No.: 13/166,259

(22) Filed: Jun. 22, 2011

(65) Prior Publication Data

US 2011/0320128 A1 Dec. 29, 2011

Related U.S. Application Data

(60) Provisional application No. 61/358,312, filed on Jun. 24, 2010.

(51) Int. Cl.
*E21B 43/16* (2006.01)
*E21B 47/10* (2012.01)

(52) U.S. Cl.
CPC ..... *E21B 43/162* (2013.01); *E21B 47/1015* (2013.01)

(58) Field of Classification Search
USPC ..... 166/250.12; 702/13
See application file for complete search history.

(56) References Cited

U.S. PATENT DOCUMENTS

| | | | | |
|---|---|---|---|---|
| 4,159,037 | A | 6/1979 | Varnon | |
| 4,445,573 | A | 5/1984 | McCaleb | |
| 4,683,949 | A * | 8/1987 | Sydansk et al. | 166/270 |
| 4,903,768 | A | 2/1990 | Shu | |
| 5,105,884 | A * | 4/1992 | Sydansk | 166/270 |
| 6,454,001 | B1 | 9/2002 | Thompson | |
| 6,454,003 | B1 | 9/2002 | Chang et al. | |
| 6,984,705 | B2 | 1/2006 | Chang et al. | |
| 7,677,313 | B2 | 3/2010 | Tremblay et al. | 166/293 |
| 2010/0022419 | A1 | 1/2010 | Reed et al. | 507/221 |
| 2010/0038086 | A1 | 2/2010 | Bunnell et al. | 166/300 |
| 2010/0051280 | A1 | 3/2010 | Akram | |
| 2010/0161292 | A1 | 6/2010 | Shook et al. | 703/2 |

FOREIGN PATENT DOCUMENTS

| | | | |
|---|---|---|---|
| GB | 2255360 A | 11/1992 | E21B 33/138 |

OTHER PUBLICATIONS

Reed, M., An Investigation of the Dixie Valley Geothermal Field, Nevada, Using Temporal Moment Analysis of Tracer Tests, 32nd Workshop on Geothermal Reservoir Engineering, Standford Univ, Standford, CA, Jan. 22-24, 2007.*

(Continued)

*Primary Examiner* — Jennifer H Gay
*Assistant Examiner* — Caroline Butcher

(57) ABSTRACT

A system and method for a conformance control treatment for a subterranean reservoir are disclosed. The system and method include performing tracer analysis between an injection well and a production well. A flow capacity and storage capacity curve is constructed from the tracer analysis. A storage capacity associated with a threshold residence time is determined using the flow capacity and storage capacity curve. A conformance control treatment is determined for the storage capacity associated with the threshold residence time. A chemical slug is injected into the injection well to increase the flow resistance in high permeability regions of a subterranean reservoir.

20 Claims, 7 Drawing Sheets

(56) References Cited

OTHER PUBLICATIONS

Du et al., Interwell Tracer Tests: Lessons Learned From Past Field Studies, Apr. 2005, Jakarta, Indonesia.
Shook et al., Determining Reservoir Properties and Flood Performance From Tracer Test Analysis, Oct. 2009, New Orleans, Louisiana.
Shook el al., A Robust Measure of Heterogeneity for Ranking Earth Models: The F-PHI Curve and Dynamic Lorentz Coefficient, Oct. 2009, New Orleans, Louisiana.
Izgec et al., Optimizing Volumetric Sweep Efficiency in Waterfloods by Integrating Streamlines, Design of Experiments, and Hydrocarbon F-Φ Curves, May 2010, Anaheim, California.
PCT International Search Report regarding PCT/US2011/041458 dated Feb. 17, 2012 (3 pgs.).
Fletcher, A.J.P., Flew, S., Forsdyke, I.N., Morgan, J.C., Rogers, C., Suttles, D., Deep Diverting Gels for Very Cost-effective Waterflood, *Journal of Petroleum Science and Engineering*, 7(1992), 33-43.
Frampton, H., Morgan, J.C., Cheung, S.K., Munsun, L, Chang, K.T., Williams, D., Development of a Novel Waterflood Conformance Control System, paper SPE 89391-MS presented at SPE/DOE Symposium on Improved Oil Recovery, Apr. 17-21, 2004, Tulsa, Oklahoma.
Garmeh, R., Izadi, M., Salehi, M. Romero, J.L., Thomas, C.P., Manrique, E.J., Thermally Active Polymer to Improve Sweep Efficiency of Waterfloods: Simulation and Pilot design Approaches, paper SPE 144234 presented at the SPE Enhanced Oil Recovery Conference held in Kuala Lumpur, Malaysia, Jul. 19-21, 2011.
Ghaddab, F., Kaddour, K., Tesconi, M., Brancolini, A., Carniani, C., Galli, G., El Borma—Brightwater: A Tertiary Method for Enhancing Oil Recovery for a Mature Field, paper SPE 136140 presented at the SPE Production and Operations Conference and Exhibition held in Tunis, Tunisia, Jun. 8-10, 2010.
Husband, M., Ohms, D., Frampton, H., Carhart, S., Carison, B., Morgan, J.C., Chang, K-T., Results of a Three-well Waterflood Sweep Improvement Trial in the Prudhoe Bay Field Using a Thermally Activated Particle System, paper SPE 129967 presented at the SPE Improved Oil Recovery Symposium held in Tulsa, Oklahoma, Apr. 24-26, 2010.
Mustoni, J.L., Norman, C.A., Denyer, P., Deep Conformance Control by a Novel Thermally Active Particle System to Improve Sweep Efficiency in Mature Waterfloods of the San Jorge Basin, paper SPE 129732 presented at the SPE/DOE Symposium on Improved Oil Recovery, Tulsa, OK, Apr. 24-28, 2010.
Pritchett, J., Frampton, H., Brinkman, J., Field Application of a New In-depth Waterflood Conformance Improvement Tool, paper SPE 84897 presented at the SPE International Improved Oil Recovery Conference, Kuala Lumpur, Malaysia, Oct. 20-21, 2003.
Roussennac, B., Toschi, C., Brightwater Trial in Salema Field (Compos Basin, Brazil), paper SPE 131299 presented at the SPE EUROPEC/EAGE Annual Conference and Exhibition held in Barcelona, Spain, Jun. 14-17, 2010.
Seright, R.S., Zhang, G., Akanni, O.O., Wang, D. , A Comparison of Polymer Flooding with In-depth Profile Modification, Paper CSUG/SPE 146087 presented at the Canadian Unconventional Resources held in Calgary, Canada, Nov. 15-17, 2011.
Shook, G.M., 2003, "A Simple, Fast Method of Estimating Fractured Reservoir Geometry from Tracer Tests," Transactions of the Geothermal Resources Council, vol. 27, September.
Shook, G.M., G.A. Pope and K. Asakawa, Determining Reservoir Properties and Flood Performance from Tracer Test Analysis, paper SPE 124614 presented at the 2009 SPE Annual Technical Conference and Exhibition, New Orleans, LA, Oct 4-7, 2009.
Wu, X, G.A. Pope, G.M. Shook, and S. Srinivasan, 2008, "Prediction of Enthalpy Production from Fractured Geothermal Reservoirs Using Partitioning Tracers," International Journal of Heat and Mass Transfer, 51 (2008), 1453-466.
Yanez, P., Mustoni, J., Relling, M., Chang, K.T., Hopkinson, P., Frampton, H. 2008. Improving Sweep Efficiency at the Mature Koluel Kaike and Piedra Clavada Waterflooding Projects, Argentina, *Journal of Petroleum Technology*, 60(1), 47-49.

* cited by examiner

SYSTEM AND METHOD FOR CONFORMANCE CONTROL IN A SUBTERRANEAN RESERVOIR

CROSS-REFERENCE TO A RELATED APPLICATION

The present application for patent claims the benefit of U.S. Provisional Application bearing Ser. No. 61/358,312, filed on Jun. 24, 2010, which is incorporated by reference in its entirety.

TECHNICAL FIELD

The present invention generally relates to a system and method for enhancing the recovery of hydrocarbons from a subterranean reservoir, and more particularly, to a system and method for optimizing the design of a conformance control treatment to increase the flow resistance in high permeability regions of a subterranean reservoir, thereby enhancing the recovery of hydrocarbons from the reservoir.

BACKGROUND

In improved oil recovery (IOR) and enhanced oil recovery (EOR) methods, fluids such as water, gas, polymer, surfactant, or combination thereof, are injected into the reservoir through injection wells to maintain reservoir pressure and drive hydrocarbons to adjacent production wells. The success of these recovery processes often depends on their ability to sweep or displace the remaining oil in the reservoir efficiently.

The geology of a reservoir largely impacts the migration or displacement path of hydrocarbons in an IOR or EOR method. In particular, heterogeneity and connectivity in a reservoir greatly impact the route injected fluids travel from an injection well to a production well. For example, the injected fluid generally flows along a low resistance route from the injection well to the production well. Accordingly, the flooding fluid often sweeps through higher permeability geologic regions of the reservoir and bypasses lower permeability geologic regions of the reservoir resulting in a non-uniform displacement of oil. Such higher permeability geologic regions of the reservoir are commonly called thief zones or streaks. Furthermore, fractures, which can be described as open cracks or voids embedded within the rock matrix, may also provide inter-well connectivity. Such connectivity often produces fluid to an intersecting production well at a rate that greatly exceeds the rate of flow through the rock matrix to the well, as the thief zone or fracture typically have a much greater capability to transport fluids.

FIG. 1 shows a schematic illustrating a physical geologic volume of an example reservoir 10 having a plurality of strata 11. The plurality of strata 11 are typically composed of sub-parallel layers of rock and fluid material each characterized by different sedimentological and fluid properties. Reservoir 10 includes strata 13 having a lower permeability and strata 15 having a higher permeability. A portion of lower permeability strata 13 of fractured reservoir 10 is cutaway to illustrate how fractures or fracture networks 17 can further provide connectivity within the reservoir formation or matrix 19 of strata 13,15.

FIG. 2 shows a cross-section of reservoir 10 including injection well 21 and production well 23, which extend to a portion of subsurface reservoir 10 that contains hydrocarbons. In particular, injection well 21 and production well 23 are in fluid communication with strata 13,15 of subsurface reservoir 10. Production well 23 is positioned a predetermined lateral distance away from injection well 21. For example, production well can be positioned between 100 feet to 10,000 feet away from injection well 21. As will be readily appreciated by those skilled in the art, additional injection wells 21 and production wells 23 can extend into reservoir 10 such that multiple production wells 23 optimally receive hydrocarbons being pushed through strata 13,15 due to injections from multiple injection wells 21.

As shown in FIG. 2, fluid 25 injected through injection well 21 tends to sweep through higher permeability strata 15 and does not uniformly sweep the hydrocarbons from lower permeability strata 13 as fluid 25 naturally follows lower resistance paths to production well 23. Furthermore, injection of fluid 25 may result in a phenomenon called fingering or channeling in which injected fluid 25 preferentially follows certain narrow paths 27 through the reservoir formation reservoir matrix 19 to reach production well 23. This non-uniform spreading results in fluid 25 bypassing substantial amounts of hydrocarbons in strata 13,15 of subterranean reservoir 10 such that the bypassed hydrocarbons are not mobilized for recovery. As previously discussed, narrow paths 27 can be due to injection fluids flowing through high permeability thief zones or through fractures to reach production well 23, thus bypassing the majority of reservoir matrix 19 if narrow paths 27 provide inter-well connectivity. In such cases, IOR and EOR processes designed to flow through reservoir matrix 19 can have limited value as fluid cycling can occur through either the fractures or high permeability thief zones.

However, various control methods have been developed to modify the permeability of high permeability thief zones and fractures in a reservoir in efforts to obtain a more uniform sweep, thereby increasing the mobilization and recovery of hydrocarbons. For example, numerous chemical methods commonly referred to as profile or conformance control treatments have been utilized to block, or at least significantly increase the flow resistance of, higher permeability strata. These conformance control treatments also can be used to plug high permeability thief zones or fractures. In particular, polymers or gels are injected into the reservoir that create a low permeability barrier such that flooding fluid thereafter is diverted away from the higher permeability strata, thief zones and fractures. The conformance control material is generally selected based on the properties of the subterranean reservoir such as temperature and salinity.

FIG. 3 shows a cross-section of fractured reservoir 10 where a conformance control treatment has been applied. Chemical slug 29, such as a gel or polymer, has been injected into reservoir 10 through injection well 21. Chemical slug 29 is designed such that it can be injected through the casings and completions of injection well 21, yet does not interfere with operation of injection well 21. Once chemical slug 29 is injected into reservoir 10, it is designed to move through the pores in the reservoir matrix 19 and set at an acceptable distance away from the injection well 21 to create a low permeability barrier within reservoir 10. In some instances, a chase fluid can be utilized to drive chemical slug 29 away from injection well 21 and further into reservoir 10. Once chemical slug 29 sets in reservoir 10 it should have sufficient strength to withstand subsequent flooding fluid injection pressures. Flooding fluid is diverted away from portions of higher permeability strata 15 and narrow paths 27, which are portions of the reservoir that have already been swept. In particular, the injected fluid is now more uniformly distributed in reservoir 10, such as through lower permeability strata 13.

Despite these efforts, many conformance control treatments have shown little or no effect on enhancing hydrocarbon recovery from a reservoir. Such failures may be attributed to the many uncertainties encountered when designing a conformance control application for a particular reservoir. For example, often it is not known where or at what depth to inject chemical slug 29. Additionally, how much chemical to inject in a particular slug is largely a form of guesswork. Finally, there is a lack of control over where chemical slug 29 flows once it enters reservoir 10, and how far away from the injection well 21 chemical slug 29 will set. Accordingly, incorrect or insufficient conformance control designs can result in oil producing zones becoming blocked in addition to the already swept zones. Any improvements in oil productivity might also be transient as the flooding fluid may eventually bypass both the chemical slug barrier and the unswept portions of the reservoir.

SUMMARY

A method is disclosed for enhancing hydrocarbon recovery in subterranean reservoirs using conformance control. Tracer data for a subterranean reservoir having a hydrocarbon containing zone therewithin is provided. The tracer data comprises residence times for a tracer to flow between an injection well and a production well that extend into the hydrocarbon containing zone of the subterranean reservoir. A target threshold residence time for the tracer to flow between the injection well and the production well is selected. A quantity of a conformance control treatment material for injection into the hydrocarbon containing zone is determined using the tracer data and the target threshold residence time.

In one or more embodiments, the quantity of the conformance control treatment material is injected into the hydrocarbon containing zone through the injection well. The quantity of the conformance control treatment material is sufficient to obstruct flow paths between the injection well and the production well where the residence times for the tracer are less than the target threshold residence time. Hydrocarbons are recovered from the hydrocarbon containing zone through the production well.

In one or more embodiments, a flow capacity and storage capacity curve is constructed while determining the quantity of the conformance control treatment material for injection into the hydrocarbon containing zone. In one or more embodiments, a storage capacity associated with the target threshold residence time determined while determining the quantity of the conformance control treatment material for injection into the hydrocarbon containing zone. In one or more embodiments, a total pore volume of the hydrocarbon containing zone is calculated while determining the quantity of the conformance control treatment material for injection into the hydrocarbon containing zone. In one or more embodiments, a volume representing higher permeability geologic regions within the hydrocarbon containing zone to be treated with the conformance control treatment material is calculated while determining the quantity of the conformance control treatment material for injection into the hydrocarbon containing zone.

In one or more embodiments, the tracer data comprises residence times for a plurality of tracers.

In one or more embodiments, the target threshold residence time is determined by balancing incremental oil recovery versus a cost of an increased size of the chemical treatment. In one or more embodiments, the target threshold residence time is selected for treating a reservoir volume of greater than about 5% of a total hydrocarbon pore volume of the hydrocarbon containing zone. In one or more embodiments, the target threshold residence time is selected for treating a reservoir volume of less than about 50% of a total hydrocarbon pore volume of the hydrocarbon containing zone.

According to another aspect of the present invention, a method is disclosed for conformance control in a subterranean reservoir. Tracer data for a subterranean reservoir having a hydrocarbon containing zone therewithin is provided. The tracer data comprises residence times for a tracer to flow between an injection well and a production well that extend into the hydrocarbon containing zone of the subterranean reservoir. A volume representing higher permeability geologic regions within the hydrocarbon containing zone to be treated with a conformance control treatment material is determined using the tracer data. A quantity of the conformance control treatment material is injected into the hydrocarbon containing zone through the injection well to increase a flow resistance in the higher permeability geologic regions within the hydrocarbon containing zone.

In one or more embodiments, the quantity of the conformance control treatment material injected into the hydrocarbon containing zone is sufficient to obstruct flow paths between the injection well and the production well where the residence times for the tracer are less than a target threshold residence time. In one or more embodiments, the volume representing higher permeability geologic regions within the hydrocarbon containing zone are associated with flow path residence times less than a target threshold residence time.

In one or more embodiments, determining the volume of the hydrocarbon containing zone to be treated with the conformance control treatment material includes constructing a flow capacity and storage capacity curve using the tracer data for the subterranean reservoir, determining a storage capacity associated with a target threshold residence time for the tracer to flow between the injection well and the production well from the flow capacity and storage capacity curve, and determining the volume of the hydrocarbon containing zone to be treated with the conformance control treatment material responsive to the storage capacity associated with the target threshold residence time.

According to another aspect of the present invention, a system is disclosed for conformance control in a subterranean reservoir. The system includes a database, a computer processer, and a computer program having software instructions. The database is configured to store tracer data for a subterranean reservoir having a hydrocarbon containing zone therewithin. The tracer data includes residence times for a tracer to flow between an injection well and a production well that extend into the hydrocarbon containing zone of the subterranean reservoir. The computer processer is configured to receive the stored data from the database and to execute software instructions using the stored data. The computer program is executable on the computer processer. The computer program includes a computational module configured to calculate a quantity of a conformance control treatment material for injection into the hydrocarbon containing zone using the tracer data.

In one or more embodiments, the computational module is further configured to construct a flow capacity and storage capacity curve using the tracer data for the subterranean reservoir, determine a storage capacity associated with a target threshold residence time from the flow capacity and storage capacity curve, and determine a volume of the hydrocarbon containing zone to be treated with the conformance control treatment material responsive to the storage capacity associated with the target threshold residence time.

In one or more embodiments, the quantity of the conformance control treatment material for injection into the hydrocarbon containing zone is sufficient to obstruct flow paths between the injection well and the production well where the residence times for the tracer are less than a target threshold residence time.

DETAILED DESCRIPTION

A system and method is disclosed for optimizing the design of a conformance control treatment to increase the flow resistance in higher permeability regions of a subterranean reservoir. As will be better understood by the further description below, optimization utilizes tracer test analysis to determine an appropriate reservoir volume to be treated with a chemical slug.

Figure 1:
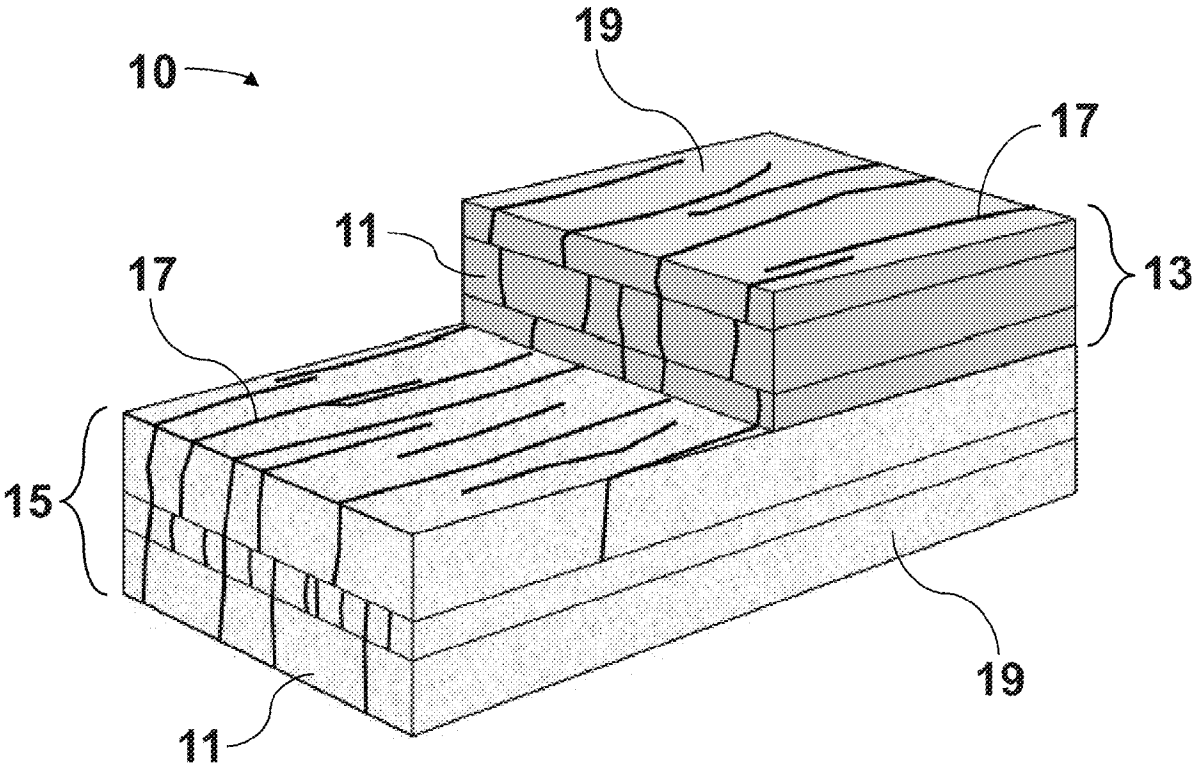
PRIOR ART Fig. 1
FIG. 1 is a schematic of a fractured reservoir domain.
Figure 2:
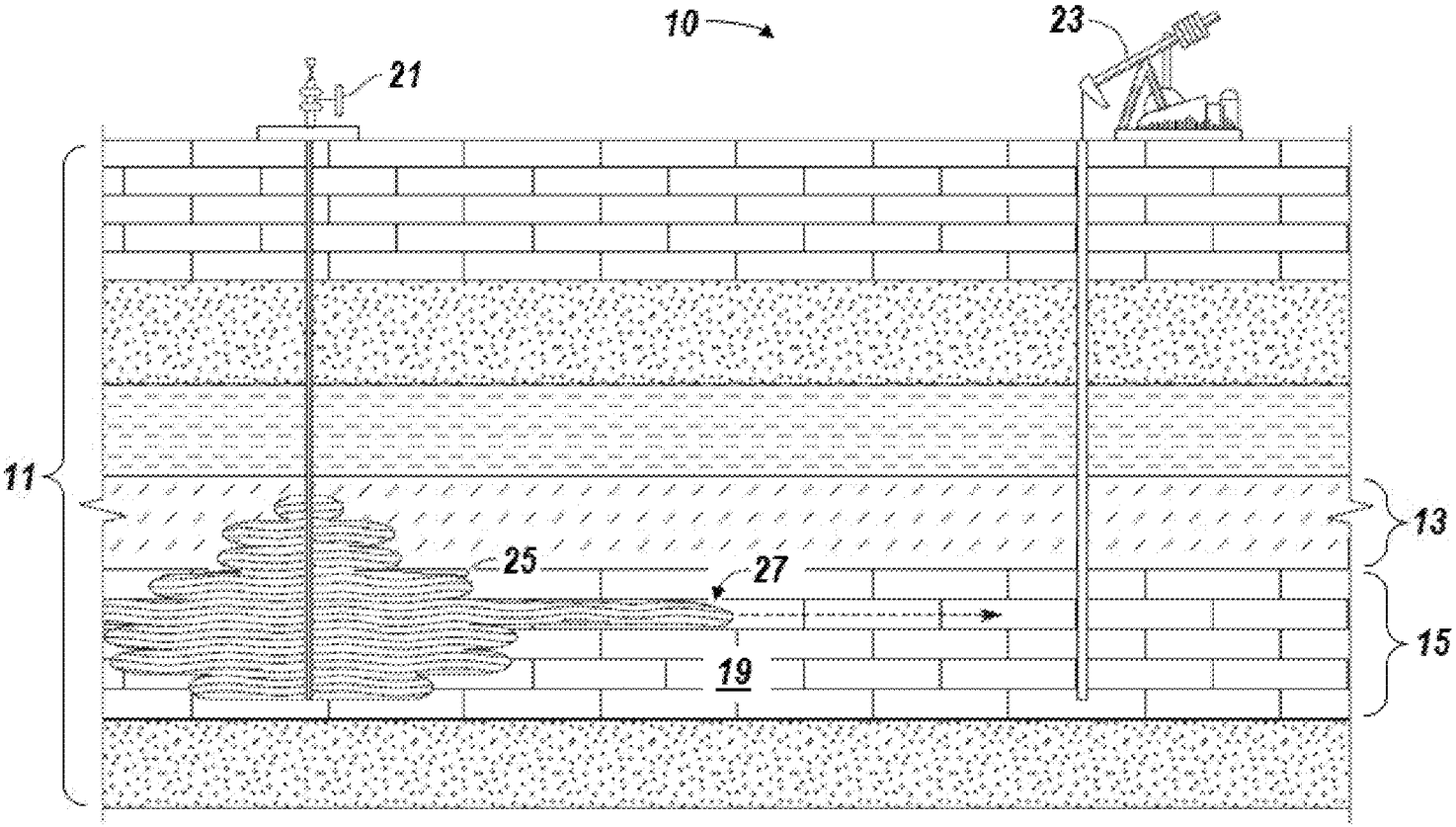
PRIOR ART Fig. 2
FIG. 2 is a cross-section of a reservoir domain undergoing a flooding process.
Figure 3:
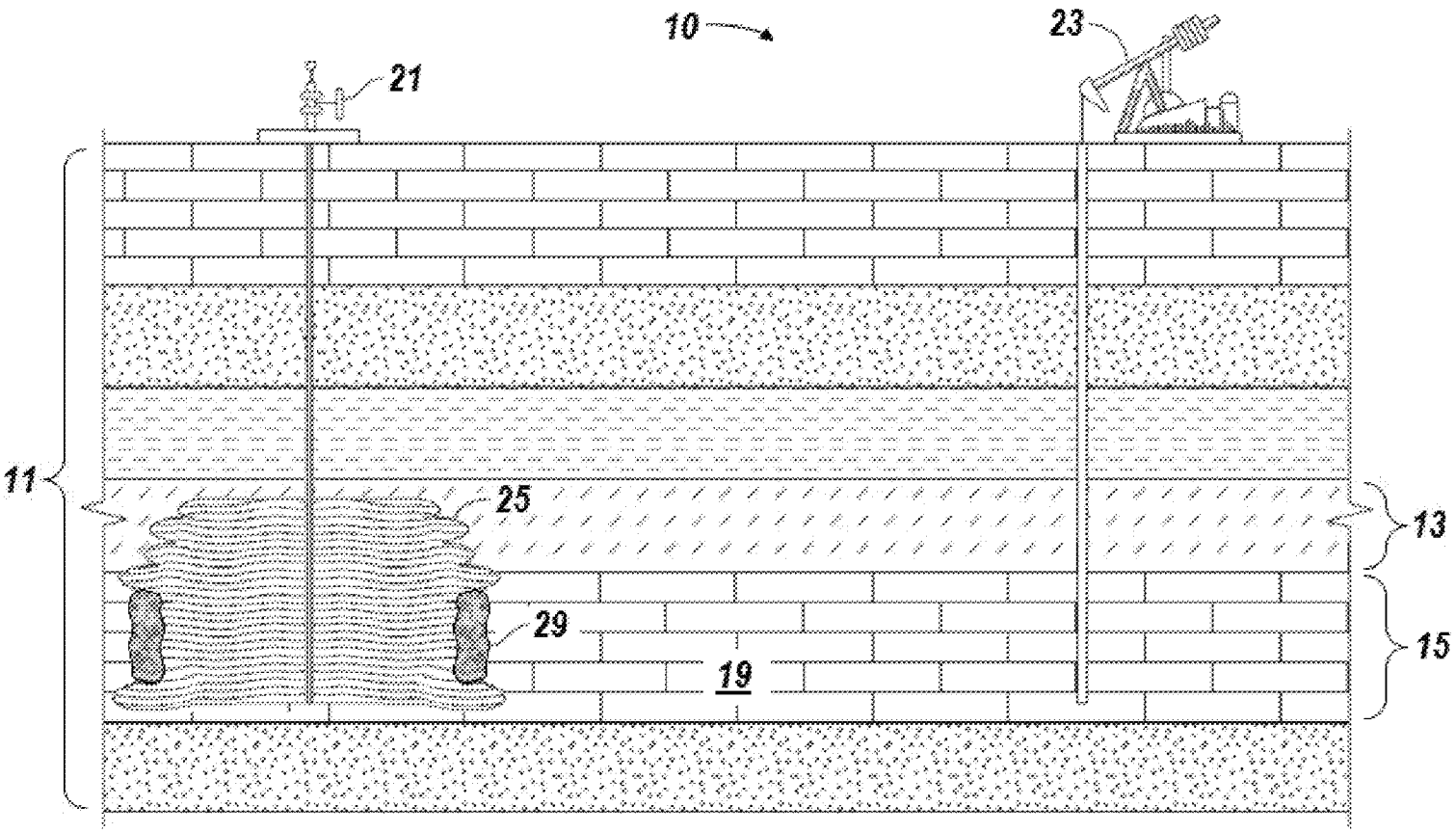
PRIOR ART Fig. 3
FIG. 3 is a cross-section of the reservoir domain shown in FIG. 2 where a conformance control treatment has been applied.
Figure 4:
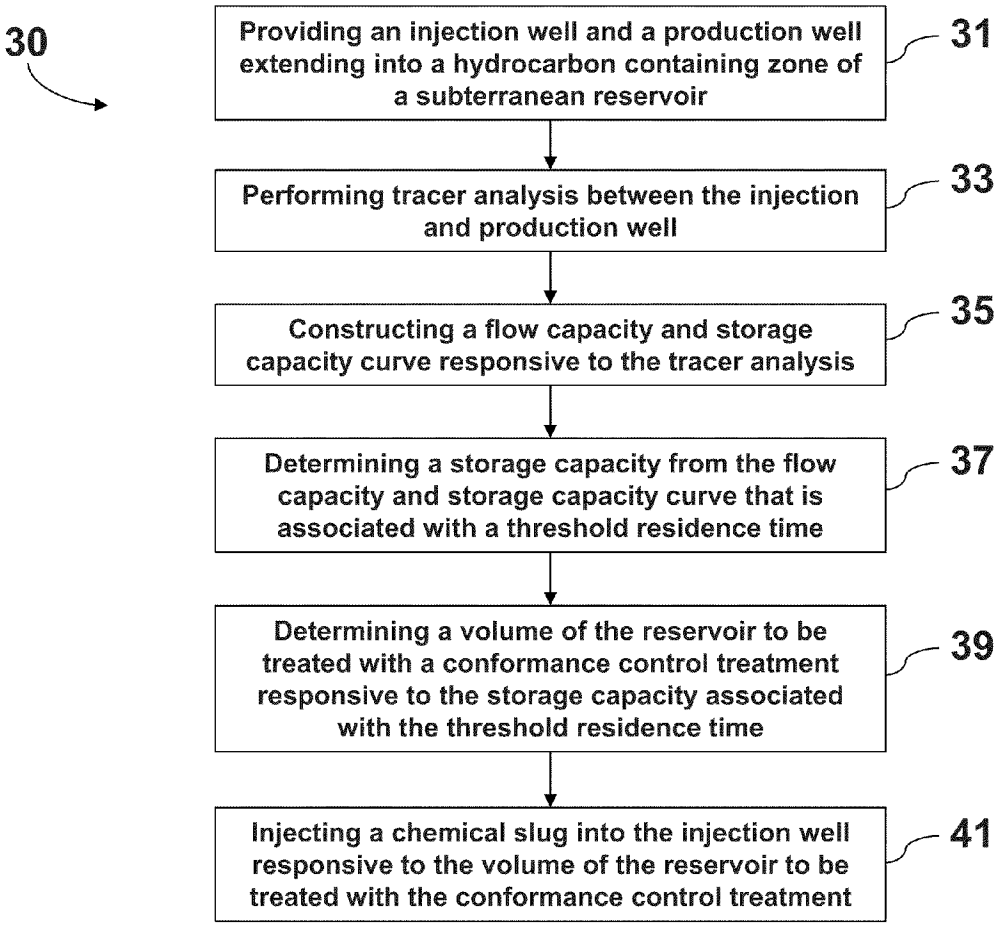
FIG. 4 is a flowchart illustrating a conformance control method, in accordance with an embodiment of the present invention.

FIG. 4 shows a flowchart illustrating method 30 for optimizing the design of a conformance control treatment for a subterranean reservoir. In step 31, an injection well and a production well are provided. The injection and production wells extend into a hydrocarbon containing zone of a subterranean reservoir. Tracer analysis between the injection well and production well is performed in step 33. In step 35, a flow capacity and storage capacity curve is constructed responsive to the tracer analysis. In step 37, a storage capacity associated with a threshold residence time is determined using the flow capacity and storage capacity curve constructed in step 35. In step 39, a volume of the reservoir to be treated with a conformance control treatment material is determined responsive to the storage capacity associated with the threshold residence time. In step 41, a chemical slug is injected into the injection well responsive to the volume of the reservoir to be treated with the conformance control treatment determined in step 39.

In method 30, tracer analysis in step 33 includes injecting a tracer into the reservoir through the injection well. Typically the tracer is injected in a tracer slug with the injected flooding fluid. Additional flooding fluid, not containing any tracer content, can act as a chase fluid to drive the tracer through the reservoir to the production well. A detector is positioned at the production well and measures tracer concentration produced with the flooding fluid.

In some embodiments, tracer analysis includes injecting multiple tracers into an injection well. Further, tracer analysis can be performed for multiple injection and production wells. Tracers are typically inert chemical compounds or isotopes having unique detectable properties. Tracers are generally selected based on the properties of the subterranean reservoir and the flooding fluid to be injected into the reservoir. For instance, the tracer can vary based on the reservoir or flooding fluid to ensure tracers remain stable in the reservoir. Accordingly, the tracer can be chosen to avoid chemical interaction with the rock matrix, reservoir fluids, or flooding fluids such as by altering the pH, viscosity, or density of fluids.

In some embodiments, the tracers can include conservative tracers that remain in an aqueous phase in the reservoir. Such tracers are generally passive tracers and do not influence the flow of fluid within the reservoir. For example, conservative tracers commonly utilized in waterflooding operations include halides, perfluorobenzoic acids (PFBAs) and sodium salts thereof, light alcohols (e.g., methanol, ethanol, propanol, butanol), thiocyanates, hexacyanocobaltates, and tritiated water. Conservative tracers commonly utilized in gas or solvent operations include perfluorocarbons, sulpher hexafluoride, and tritiated hydrocarbons such as tritiated methane.

In step 35 of method 30, flow capacity and storage capacity of flow paths between the injection and production wells can be computed using the tracer data. As will be described in further detail below, the tracer concentration history obtained from the production well can be used to compute a residence time distribution of the produced tracer, which can be generalized to construct a dynamic flow capacity-storage capacity curve. While step 35 of method 30 includes constructing a flow capacity and storage capacity curve, one skilled in the art will appreciate that other means for determining or representing a relationship between flow capacity and storage capacity can alternatively be used such as charts or look-up tables.

Static flow capacity-storage capacity curves can be computed for individual flow paths within a layered reservoir. In this case, the flow paths are represented as layers that have unique values of permeability, porosity, and thickness, but equal cross sectional area, and length. The flow capacity of an individual streamline can be described as the volumetric flow of that layer, divided by the total volumetric flow. The storage capacity can be computed as the layer pore volume divided by the total pore volume. Thus, the flow capacity ($f_i$) and storage capacity ($c_i$) of layer "i" can be computed using Darcy's law and defining N layers each having a different permeability (k), porosity ($\phi$), and thickness (h). In particular, flow capacity ($f_i$) can be computed using the following equation:

$$f_i = \frac{q_i}{\sum_{i=1}^{N} q_i} = \frac{(kh)_i}{\sum_{i=1}^{N} (kh)_i} \quad \text{(Equation 1)}$$

Similarly, the storage capacity can be computed using the following equation:

$$c_i = \frac{V_{P_i}}{\sum_{i=1}^{N} V_{P_i}} = \frac{(\varphi h)_i}{\sum_{i=1}^{N} (\varphi h)_i} \quad \text{(Equation 2)}$$

An F-C diagram can be constructed by computing the cumulative distribution function of flow capacity (f) and storage capacity (c). Therefore, the cumulative distribution functions for flow capacity ($F_i$), which represents the volumetric flow of all layers, and for storage capacity ($C_i$) which represents the pore volume associated with those layers, can be written as:

$$F_i = \frac{\sum_{j=1}^{i} q_j}{\sum_{j=1}^{N} q_i} = \frac{\sum_{j=1}^{i} (kh)_j}{\sum_{j=1}^{N} (kh)_j} \quad \text{(Equation 3)}$$

$$C_i = \frac{\sum_{j=1}^{i} Vp_j}{\sum_{j=1}^{N} Vp_j} = \frac{\sum_{j=1}^{i} (\varphi h)_j}{\sum_{j=1}^{N} (\varphi h)_j} \quad \text{(Equation 4)}$$

While these simple F-C curves can provide a basic understanding of flow geometry, they are based on the assumptions of two-dimensional flow, constant intra-layer properties, uniform flow path lengths, equal pressure drops in each layer, and no cross flow between layers. However, flow path lengths in three-dimensional heterogeneous media are generally not constant, nor are flow path properties constant. In particular, the pressure field created by the sink and source terms (production and injection wells) typically results in different flow path lengths due to connectivity and the variation in reservoir properties therebetween. Accordingly, such flow paths arising from static layer properties have proved to be less realistic and accurate compared to those constructed using dynamic data.

The volumetric flow of all layers ($F_i$) and the pore volume associated with those layers ($C_i$) in Equations 3 and 4, respectively, can be computed from the dynamic tracer data using the residence time distribution of the produced tracer. The mean residence time is the time-weighted average residence time of all flow paths between an injection and production well pair. Accordingly, the mean residence volume of flow paths faster than "i" breaking through at time (t) can be written as:

$$\bar{V} = \frac{\int_0^\infty qC(t)dt}{\int_0^\infty Cdt} \quad \text{(Equation 5)}$$

Normalizing the mean residence volume of flow paths given in Equation 5 by the total mean residence volume of all flow paths gives the fraction of the total swept volume that is completely swept at time (t). Accordingly, the dynamic incremental pore volume ($\Phi_i$) similar to the static incremental pore volume ($C_i$) of Equation 4 can be written as:

$$\Phi_i = \frac{\sum_{j=1}^{i} Vp_j}{\sum_{j=1}^{N} Vp_j} \cong \frac{\int_0^t qC\tau d\tau}{\int_0^\infty qCtdt} = \Phi(t) \quad \text{(Equation 6)}$$

Furthermore, because the fractional recovery of the tracer is proportional to the relative volumetric flow rate of flow paths, the flow capacity of streamlines can be estimated from the rate of tracer recovery. Accordingly, flow capacity ($F_i$) can be written as:

$$F_i = \frac{\sum_{j=1}^{i} q_j}{\sum_{j=1}^{N} q_j} \cong \frac{\int_0^t C(\tau)d\tau}{\int_0^\infty C(t)dt} = F(t) \quad \text{(Equation 7)}$$

Figure 5:
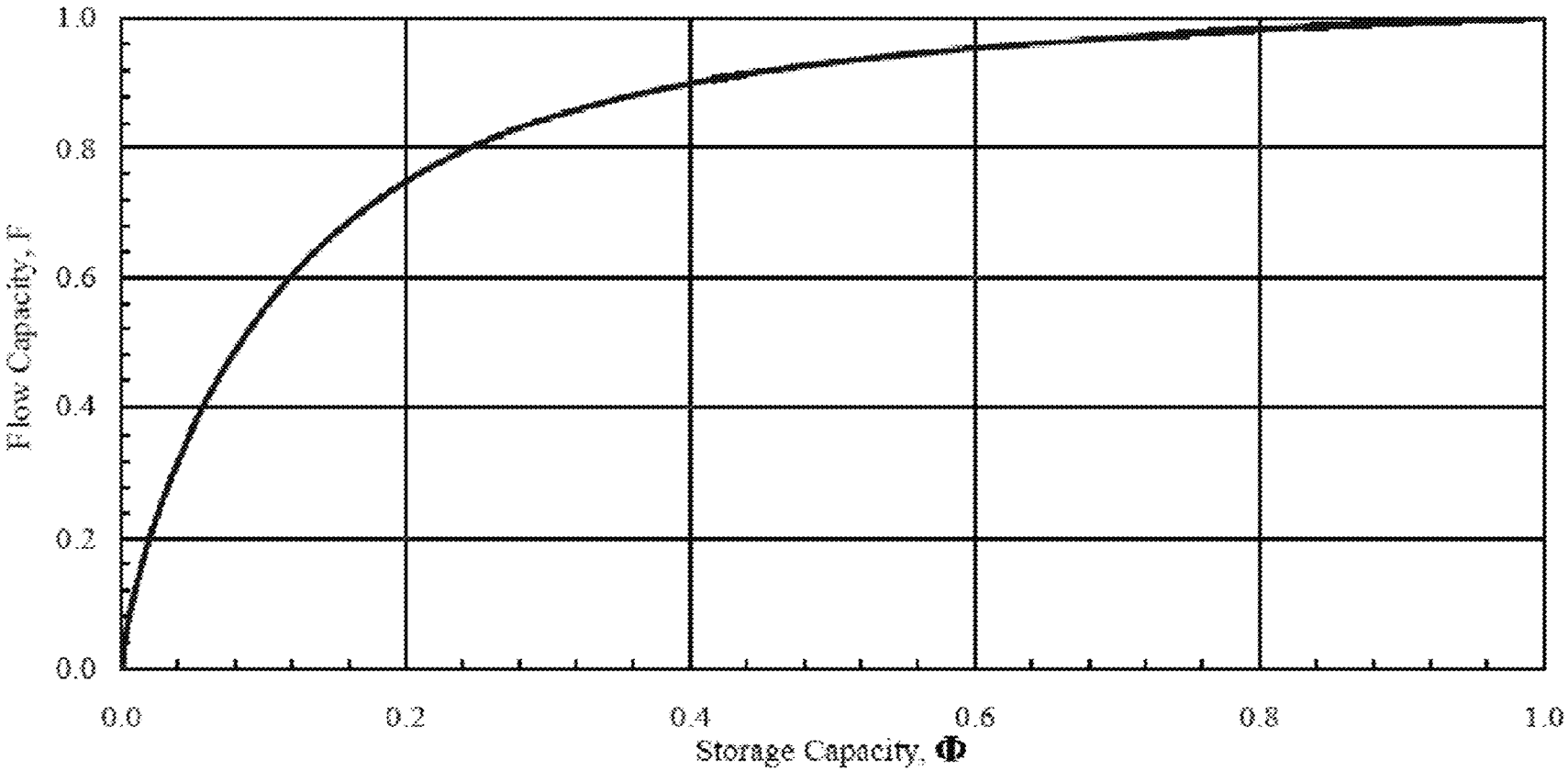
FIG. 5 is a Flow Capacity—Storage Capacity diagram, in accordance with an embodiment of the present invention.

FIG. 5 is a schematic of a Flow Capacity (F)-Storage Capacity (Φ) diagram. From the F-Φ curve, it can be observed that approximately 60 percent of the flow is produced through about 12 percent of the pore volume. Furthermore, approximately 80 percent of the flow is produced through about 25 percent of the pore volume.

In step 37 of method 30 (FIG. 4), a storage capacity associated with a threshold residence time is determined using the flow capacity and storage capacity curve constructed in step 35. The slope of the F-Φ curve is the mean residence time divided by the residence time of a given flowpath. The slope of the F-Φ curve is given by $$\frac{dF}{d\Phi} = \frac{\bar{t}}{\tau} \quad \text{(Equation 8)}$$

where τ is the residence time of a given flowpath and $\bar{t}$ is the mean residence time. This indicates that the slope of the F-Φ curve is qualitatively related to the geology of the reservoir. In particular, low residence times or large slopes are indicative of thief zones, while high residence times or low slopes are indicative of low permeability or stagnation zones. As will be discussed, a threshold residence time is selected such that flow paths having residence times lower than the threshold can be shut-off or killed. The decision on selecting the threshold time is typically based on balancing improved oil recovery versus the added cost of increasing the slug size. In some embodiments, the threshold residence time is selected as a residence time of about fifty percent (50%) of the average residence time. In some embodiments, the threshold residence time is selected as a residence time of about forty percent (40%) of the average residence time. In some embodiments, the threshold residence time is selected as a residence time of about thirty percent (30%) of the average residence time. In some embodiments, the threshold residence time is selected as a residence time of about twenty percent (20%) of the average residence time. In some embodiments, the threshold residence time is selected as a residence time of about ten percent (10%) of the average residence time.

Figure 6:
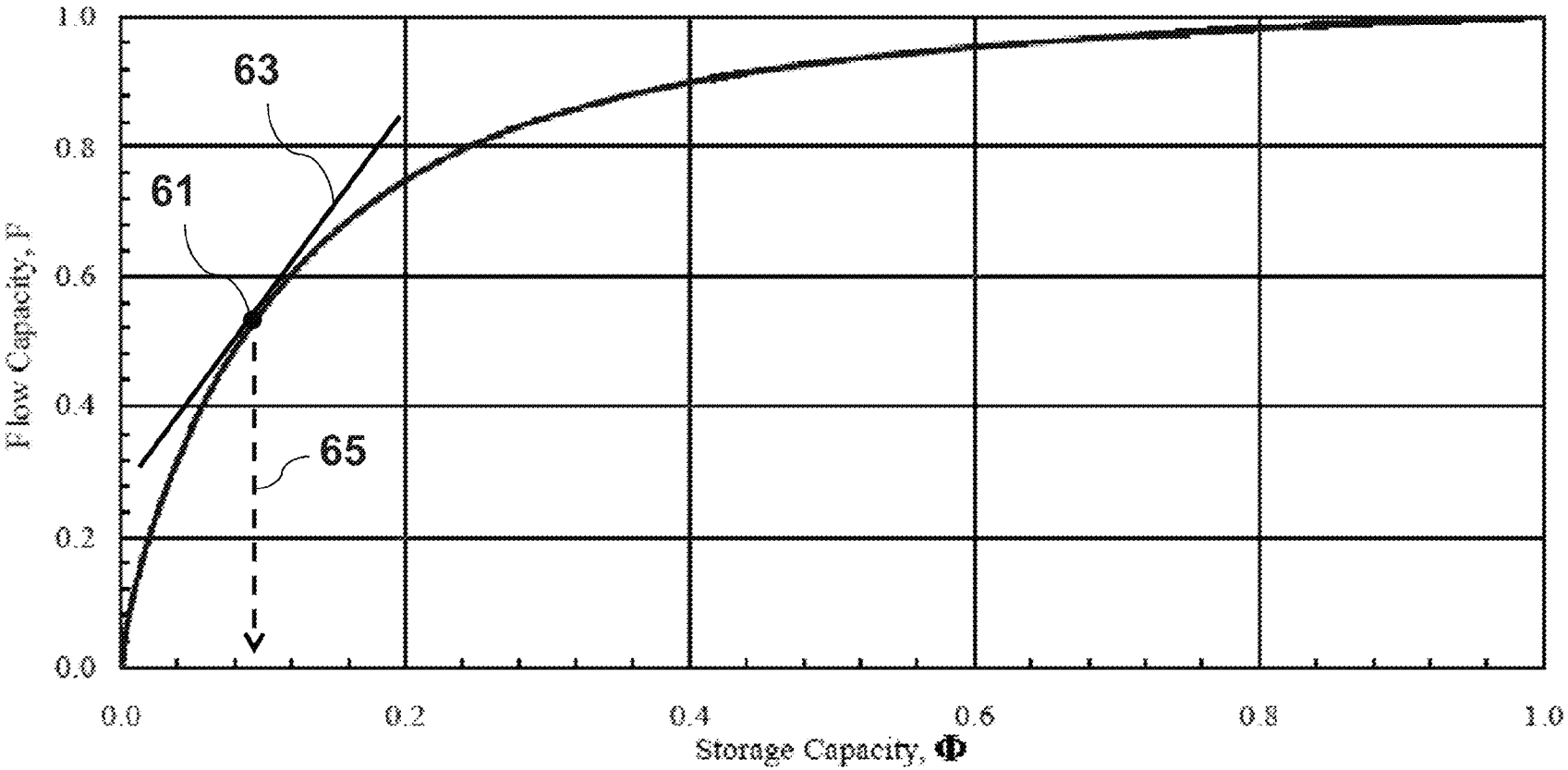
FIG. 6 is a Flow Capacity—Storage Capacity diagram, in accordance with an embodiment of the present invention.

FIG. 6 is a schematic of a Flow Capacity (F)-Storage Capacity (Φ) diagram illustrating how a storage capacity associated with a threshold residence time is determined. Point 61 on the F-Φ curve corresponds to tangent line 63 having a slope associated with the threshold residence time. For example, if the threshold residence time is selected as a residence time being a third of the average residence time, the tangent corresponds to a point on the F-Φ curve having a slope of three. The storage capacity associated with point 61 is approximately ten percent of the pore volume, as shown by dashed line 65. Since the total pore volume of the reservoir can be determined using Equation 5, the volume of reservoir to be treated can be readily calculated.

Referring back to FIG. 4, a conformance control treatment is determined responsive to the storage capacity associated with the threshold residence time in step 39 of method 30. In particular, the quantity of conformance control material needed to treat or kill off the storage capacity associated with the threshold residence time is determined. Using the storage capacity associated with the threshold residence time and the total swept pore volume (Vp) the reservoir volume to be treated can be computed using Equation 6. The total swept pore volume can be determined directly from tracer analysis. Most frequently a small slug of tracer is injected into the reservoir, followed by chase fluid, and the total swept pore volume (Vp) can be estimated using Equation 5. Alternatively, tracer can be injected continuously and a variation of Equation 5 can be utilized.

In step 41, a chemical slug is injected into the injection well responsive to the conformance control treatment determined in step 39. As previously described, the conformance control treatment material is typically injected into injection well as a chemical slug such that it can block already swept pore volumes and redirect the flooding fluid to unswept oil-rich zones. For example, one type of conformance control treatment material is available under the trade name of BrightWater®, which is manufactured and commercially available from TIORCO, headquartered in Denver, Colo. BrightWater® is a sub-micron particulate chemistry designed such that the particles expand to multiple times their original volume, blocking pore throats in the reservoir rock matrix at a predetermined "in-depth" location within the reservoir.

The computational steps of the methods disclosed herein may be performed on various types of computer architectures, such as for example on a single general purpose computer or workstation, on a networked system, in a client-server configuration, in an application service provider configuration, or a combination thereof. An exemplary computer system 70 suitable for implementing the computational steps of the methods disclosed herein, such as steps 35, 37, and 39 of method 30, is illustrated in FIG. 7.

Figure 7:
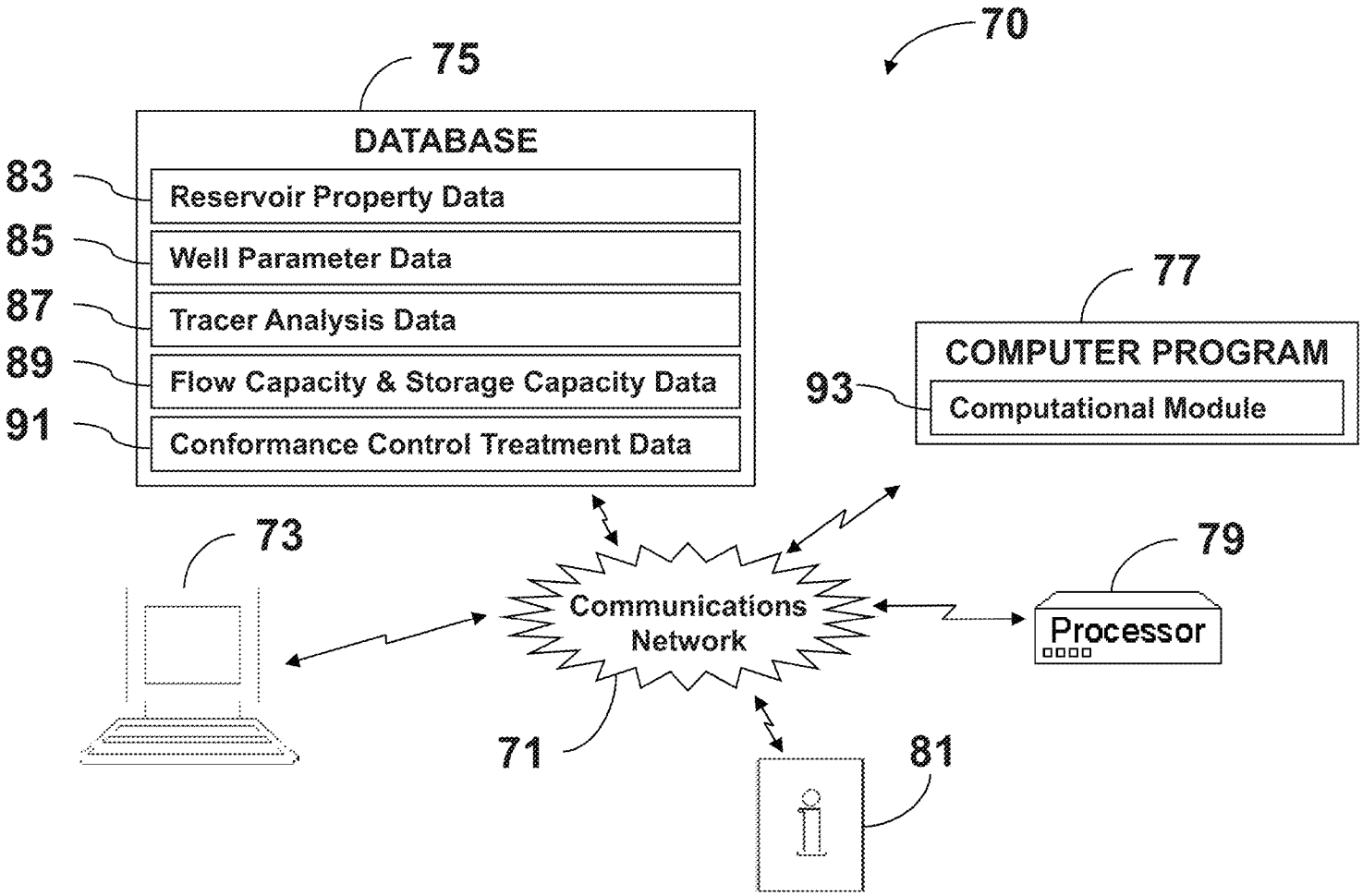
FIG. 7 illustrates a system for optimizing the design of a conformance control treatment, in accordance with an embodiment of the present invention.

As shown in FIG. 7, computer system 70, which can implement one or more method steps disclosed herein, can be linked to network 71. Communication between any components of system 70, such as user interface 73, database 75, computer program 77, processor 79 and reporting unit 81 can be transferred over communications network 71. Communications network 71 can be any means that allows for information transfer such as the Internet. Accordingly, examples of such a communications network 71 presently include, but are not limited to, a personal area network (PAN), a local area network (LAN), a wide area network (WAN), a global area network (GAN), and combinations thereof. Communications network 71 also includes hardware technology, data signals, and a combination thereof, to connect the individual devices of network 71. For example, optical cables and wireless radio frequency can be used to connect devices to network 71.

One or more user interfaces 73 can be used to access computer system 70, such as through network 71, so that an operator can actively input information and review operations of system 70. User interface 73 can be any means in which a person is capable of interacting with system 70 such as a keyboard, mouse, touch-screen display, or a handheld graphic user interface (GUI) including a personal digital assistant (PDA). Input that is entered into system 70 through user interface 73 can be stored in a database 75. Additionally, any information generated by system 70 can also be stored in database 75.

The systems' and methods' data (e.g., associations, mappings, data input, data output, intermediate data results, final data results) may be stored and implemented in one or more different types of computer-implemented databases 75, such as different types of storage devices and programming constructs (e.g., RAM, ROM, flash memory, flat files, databases, programming data structures, programming variables, IF-THEN (or similar type) statement constructs). It is noted that data structures describe formats for use in organizing and storing data in databases, programs, memory, or other computer-readable media for use by a computer program. As an illustration, a system and method can be configured with one or more data structures resident in a memory for storing data such as data representing reservoir properties 83, injection and production well conditions and operating parameters 85, tracer analysis 87, flow capacity-storage capacity curves 89, and conformance control treatments 91.

Computer program 77 can access data 83, 85, 87, 89, 91 stored in the database 75 for generating the results described herein. Computer program 77 includes software instructions which may include source code, object code, machine code, or any other stored data that is operable to cause a processing system 79 to perform the methods and operations described herein. Accordingly, a computer can be programmed with instructions to perform the steps 35, 37, and 39 of method 30 shown in the flowchart of FIG. 4. For example, computation module 93 of computer program 77 can be configured to compute flow capacity and storage capacity, a storage capacity for a predetermined threshold residence time, the fraction of the pore volume to be treated with the conformance control chemical slug, or a combination thereof.

Processor 79 interprets instructions to execute computer program 77, as well as, generates automatic instructions to execute computer program 77 responsive to predetermined conditions. Instructions from both user interface 73 and computer program 77 are processed by processor 79 for operation of system 70. The methods and systems described herein may be implemented on a single processor or many different types of processing devices or servers.

In certain embodiments, system 70 can include reporting unit 81 to provide information to the operator or to other systems (not shown) connected to network 71. For example, reporting unit 81 can be a printer, display screen, or a data reporting device. However, it should be understood that system 70 need not include reporting unit 81, and alternatively user interface 73 can be utilized for reporting any information of system 70 to the operator. For example, the output can be visually displayed to the user using a monitor or user interface device such as a handheld graphic user interface (GUI) including a personal digital assistant (PDA).

An embodiment of the present disclosure provides a computer-readable medium storing a computer program executable by a computer for performing the steps of any of the methods disclosed herein. A computer program product can be provided for use in conjunction with a computer having one or more memory units and one or more processor units, the computer program product including a computer readable storage medium having a computer program mechanism encoded thereon, wherein the computer program mechanism can be loaded into the one or more memory units of the computer and cause the one or more processor units of the computer system to execute various steps illustrated in the flowchart of FIG. 4. In particular, the computer program can interact with a computer system for performing the steps of method 30 such as computing flow capacity and storage capacity, computing a storage capacity for a predetermined threshold residence time, and computing the fraction of the pore volume to be treated with the conformance control chemical slug.

The computer components, software modules, functions, databases described herein may be connected directly or indirectly to each other in order to allow the flow of data needed for their operations. A module or processor includes, but is not limited to, a unit of code that performs a software operation, and can be implemented for example as a subroutine unit of code, as a software function unit of code, as an object (as in an object-oriented paradigm), as an applet, in a computer script language, or as another type of computer code. The software components and/or functionality may be located on a single computer or distributed across multiple computers depending upon the situation at hand.

While in the foregoing specification this invention has been described in relation to certain preferred embodiments thereof, and many details have been set forth for purpose of illustration, it will be apparent to those skilled in the art that the invention is susceptible to alteration and that certain other details described herein can vary considerably without departing from the basic principles of the invention.

Furthermore, it should be understood that as used in the description herein and throughout the claims that follow, the meaning of "a," "an," and "the" includes plural reference unless the context clearly dictates otherwise. Also, as used in the description herein and throughout the claims that follow, the meaning of "in" includes "in" and "on" unless the context clearly dictates otherwise. Finally, as used in the description herein and throughout the claims that follow, the meanings of "and" and "or" include both the conjunctive and disjunctive and may be used interchangeably unless the context expressly dictates otherwise.

NOMENCLATURE f=flow capacity of a given layer
c=storage capacity of a given layer
F=cumulative flow capacity (either from static or dynamic measurements)
C=cumulative static storage capacity
Φ=cumulative dynamic storage capacity
q=flow rate, RB/D
k=permeability, mD
h=thickness, $ft^3$
N=reservoir layer
ϕ=porosity
Vp=pore volume, $ft^3$
τ=time of flight, D
$\bar{t}$=mean residence time, D
t=time, D

What is claimed is:

1. A method for conformance control in a subterranean reservoir, the method comprising:

providing tracer data for a subterranean reservoir having a hydrocarbon containing zone therewithin, the tracer data comprising residence times for a tracer to flow between an injection well and a production well that extend into the hydrocarbon containing zone of the subterranean reservoir;

constructing a Flow Capacity-Storage Capacity curve from the tracer data using at least one computer processor;

determining, using the at least one computer processor, a storage capacity associated with a target threshold residence time from the constructed Flow Capacity-Storage Capacity curve, wherein the target threshold residence time is selected for treating a fraction of less than about 50% of a total hydrocarbon pore volume of the hydrocarbon containing zone;

determining, using the at least one computer processor, the fraction of less than about 50% of the total hydrocarbon pore volume of the hydrocarbon containing zone to be treated with a conformance control treatment material responsive to the determined storage capacity associated with the threshold residence time; and determining, using the at least one computer processor, a quantity of the conformance control treatment material for injection into the hydrocarbon containing zone based on the fraction to be treated.

2. The method of claim 1, wherein the quantity of the conformance control treatment material is sufficient to obstruct flow paths between the injection well and the production well where the residence times are less than the target threshold residence time.

3. The method of claim 1, wherein the quantity of the conformance control treatment material is injected into the hydrocarbon containing zone through the injection well.

4. The method of claim 1, wherein hydrocarbons are recovered from the hydrocarbon containing zone through the production well.

5. The method of claim 1, further comprising calculating the total pore volume of the hydrocarbon containing zone.

6. The method of claim 1, wherein the fraction represents higher permeability geologic regions within the hydrocarbon containing zone to be treated with the conformance control treatment material.

7. The method of claim 1, wherein the tracer data comprises residence times for a plurality of tracers.

8. The method of claim 1, further comprising determining the target threshold residence time by balancing incremental oil recovery versus a cost of an increased size of a chemical treatment.

9. The method of claim 1, wherein the target threshold residence time is further selected for treating the fraction of greater than about 5% of the total hydrocarbon pore volume of the hydrocarbon containing zone.

10. A method for conformance control in a subterranean reservoir, the method comprising:

providing tracer data for a subterranean reservoir having a hydrocarbon containing zone therewithin, the tracer data comprising residence times for a tracer to flow between an injection well and a production well that extend into the hydrocarbon containing zone of the subterranean reservoir;

constructing a Flow Capacity-Storage Capacity curve from the tracer data;

determining a storage capacity associated with a target threshold residence time from the constructed Flow Capacity-Storage Capacity curve, wherein the target threshold residence time is selected for treating a fraction of less than about 50% of a total hydrocarbon pore volume of the hydrocarbon containing zone;

determining the fraction of less than about 50% of the total hydrocarbon pore volume of the hydrocarbon containing zone to be treated with a conformance control treatment material responsive to the determined storage capacity associated with the threshold residence time;

determining a quantity of the conformance control treatment material for injection into the hydrocarbon containing zone based on the fraction to be treated; and injecting the quantity of the conformance control treatment material into the hydrocarbon containing zone through the injection well to increase a flow resistance in the fraction of the hydrocarbon containing zone.

11. The method of claim 10, wherein the quantity of the conformance control treatment material injected into the hydrocarbon containing zone is sufficient to obstruct flow paths between the injection well and the production well where residence times are less than a target threshold residence time.

12. The method of claim 10 wherein the fraction represents higher permeability geologic regions within the hydrocarbon containing zone that is associated with flow path residence times less than a target threshold residence time.

13. The method of claim 10, further comprising: recovering hydrocarbons from the hydrocarbon containing zone through the production well.

14. The method of claim 10, wherein the target threshold residence time is further selected for treating the fraction of greater than about 5% of the total hydrocarbon pore volume of the hydrocarbon containing zone.

15. A system for conformance control in a subterranean reservoir, the system comprising:

a database configured to store tracer data for a subterranean reservoir having a hydrocarbon containing zone therewithin, the tracer data including residence times for a tracer to flow between an injection well and a production well that extend into the hydrocarbon containing zone of the subterranean reservoir;

a computer processer configured to receive the stored data from the database, and to execute software instructions using the stored data; and a computer program having software instructions executable on the computer processer to cause the computer processor to:

construct a Flow Capacity-Storage Capacity curve from the tracer data;

determine a storage capacity associated with a target threshold residence time from the constructed Flow Capacity-Storage Capacity curve, wherein the target threshold residence time is selected for treating a fraction of less than about 50% of a total hydrocarbon pore volume of the hydrocarbon containing zone;

determine the fraction of less than about 50% of the total hydrocarbon pore volume of the hydrocarbon containing zone to be treated with a conformance control treatment material responsive to the determined storage capacity associated with the threshold residence time; and determine a quantity of the conformance control treatment material for injection into the hydrocarbon containing zone based on the fraction to be treated.

16. The system of claim 15, wherein the quantity of the conformance control treatment material for injection into the hydrocarbon containing zone is sufficient to obstruct flow paths between the injection well and the production well where residence times are less than the target threshold residence time.

17. The system of claim 15, wherein the fraction represents higher permeability geologic regions within the hydrocarbon containing zone to be treated with the conformance control treatment material.

18. The system of claim 15, wherein the computer program further includes software instructions executable on the computer processer to cause the computer processor to determine the target threshold residence time by balancing incremental oil recovery versus a cost of an increased size of a chemical treatment.

19. The system of claim 15, wherein the target threshold residence time is further selected for treating the fraction of greater than about 5% of the total hydrocarbon pore volume of the hydrocarbon containing zone.

20. The system of claim 15, wherein the computer program further includes software instructions executable on the computer processer to cause the computer processor to calculate the total pore volume of the hydrocarbon containing zone.

* * * * *